US010369571B1

(12) United States Patent
Nguyen-DeMary

(10) Patent No.: US 10,369,571 B1
(45) Date of Patent: Aug. 6, 2019

(54) MICRO-TITRATION VESSEL

(71) Applicant: Merck Sharp & Dohme Corp., Rahway, NJ (US)

(72) Inventor: Tinh Nguyen-DeMary, Milltown, NJ (US)

(73) Assignee: Merck Sharp & Dohme Corp., Rahway, NJ (US)

( * ) Notice: Subject to any disclaimer, the term of this patent is extended or adjusted under 35 U.S.C. 154(b) by 0 days.

(21) Appl. No.: 15/941,643

(22) Filed: Mar. 30, 2018

(51) Int. Cl.
*B01L 3/00* (2006.01)

(52) U.S. Cl.
CPC ..... *B01L 3/52* (2013.01); *B01L 2200/025* (2013.01); *B01L 2200/16* (2013.01); *B01L 2300/08* (2013.01); *B01L 2300/0851* (2013.01); *B01L 2300/0858* (2013.01); *B01L 2300/12* (2013.01)

(58) Field of Classification Search
CPC .. B01L 3/14; B01L 3/50; B01L 3/5021; B01L 2200/025; B01L 2300/0858; B01L 3/52; B01L 3/502; B01L 3/5082; G01N 21/07
See application file for complete search history.

(56) References Cited

U.S. PATENT DOCUMENTS 5,948,365 A * 9/1999 Macy ..... B01L 3/5082 422/550
2003/0213312 A1* 11/2003 DeYoung ..... B01L 3/5082 73/864
2010/0297707 A1* 11/2010 Lee ..... B01L 3/50851 435/91.2
2011/0044867 A1* 2/2011 Cefaratti ..... B01L 3/50825 422/550

OTHER PUBLICATIONS

Titration Beakers, Overview, Mettler Toledo, undated, 3 pages [Online] [Retrieved on May 4, 2018] Retrieved from the Internet<URL:https://www.mt.com/au/en/home/products/Laboratory_Analytics_Browse/Product_Family_Browse_titrators_main/Family_Browse_Titration_Acc_main/Product_Family_Titration_other_acc/Titration_Beakers_1.html>.
Cup, Thomas Scientific, 2018, 10 pages, [Online] [Retrieved on May 4, 2018] Retrieved from the Internet<URL:https://www.thomassci.com/scientific-supplies/Cup>.

* cited by examiner

*Primary Examiner* — Jill A Warden
*Assistant Examiner* — Dwayne K Handy
(74) *Attorney, Agent, or Firm* — Fenwick & West LLP

(57) ABSTRACT

A micro-titration vessel may include a plurality of fins protruding outward from an exterior wall of a cup and flush with the bottom of the cup to provide stability to the vessel. Interior walls of the cup are angled inward at multiple points along the body of the cup, resulting in a small surface area at the bottom of the cup where titration occurs.

11 Claims, 4 Drawing Sheets

MICRO-TITRATION VESSEL

TECHNICAL FIELD

The subject matter described herein generally relates to titration, and more specifically, to a micro-titration vessel having a plurality of fins.

BACKGROUND

Titration is a common laboratory method for chemical analysis that is routinely used in early pharmaceutical development. It is used to determine the solubility of the active pharmaceutical ingredient (API), which is essential to the drug's eventual safety and efficacy. Typically, up to several hundred milligrams of API titrant is required for accurate titration; however, such large amounts of API may be difficult and/or expensive to obtain early in the development process. In order to avoid wasting API, current methods use micro-pipettes to manually deliver extremely small amounts of titrant. However, this process is inefficient and often inaccurate.

BRIEF DESCRIPTION OF THE DRAWINGS

The disclosed embodiments have advantages and features which will be more readily apparent from the following detailed description and the appended claims, when taken in conjunction with the accompanying drawings, in which:

DETAILED DESCRIPTION

The figures and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

A micro-titration vessel may have a plurality of uniform fins flush with the bottom of the vessel provides for improved stability of the vessel. The inward angling of the walls at an approximate midpoint of the vessel results in a decreased diameter at the bottom of the vessel where titration occurs, thus reducing the amount of titrant required to perform the titration and reducing waste.

Figure 1:
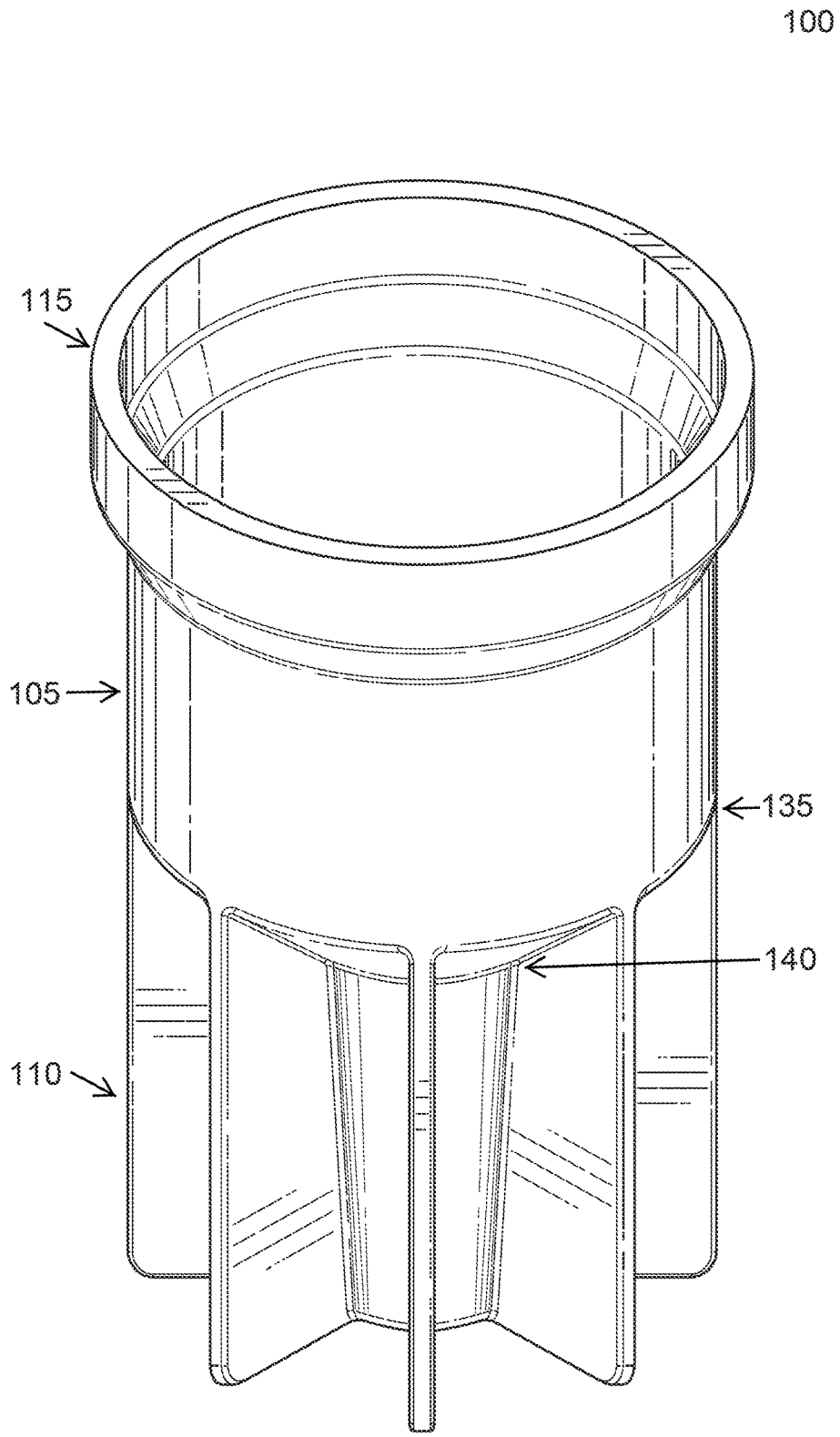
FIG. 1 illustrates a front perspective view of a micro-titration vessel, according to an example embodiment.

Referring now to FIG. 1, it illustrates one example embodiment of a micro-titration vessel 100. In the embodiment shown, the micro-titration vessel 100 includes a cup 105 structured to receive content through an opening at a top 115 of the cup 105 and a plurality of fins 110 protruding outward from an approximate midpoint of the exterior wall of the cup 105.

The vessel 100 may be made of nylon, acrylonitrile butadiene styrene (ABS) plastic, thermoplastic polymer (such as polyethylene, polypropylene, or polytetrafluoroethylene), or another rigid material and may be manufactured using injection molding, panel forming, blow molding, thermoforming, 3D printing, or the like. The vessel 100 may be constructed in a single piece or in multiple pieces. For example, in one example embodiment, the fins 110 are constructed separate from, and overlaid on, the cup 105. In another example embodiment, the cup 105 with attached fins 110 is constructed in multiple pieces and assembled to form the vessel 100. In one such instance, the vessel 100 is vacuum molded as two separate, symmetrical pieces that are then bonded together (e.g., by pressing the two pieces together while the material is still hot). The two pieces may be joined such that the connecting plane passes through a pair of fins 110, thus increasing the bonded contact area.

In the embodiment shown in FIG. 1, the height of the vessel 100 is approximately 80-100 millimeters, and the diameter is approximately 40-75 millimeters. The height of the fins 110 is approximately 40-60 millimeters such that the fins 110 extend downward from a third point 135 along the exterior wall of the cup 105. In other embodiments, the dimensions of the various portions of the vessel 100 may be different.

The cup 105 has a top 115 and a bottom 120. In one example embodiment, the cup 105 is hollow and has an interior and exterior wall and is structured to receive content (e.g., liquid) through an opening at the top 115 of the cup 105. The bottom 120 of the cup 105 has a flat surface and is enclosed for holding content received through the opening. The cup 105 includes a top portion having interior walls defining a top cavity extending downward from a second point 130 to a third point 135 and a bottom portion having interior walls defining a bottom cavity extending downward from the third point 135 to the bottom 120 of the cup 105. In one example embodiment, the interior walls defining the top cavity are vertical (i.e., at a 90-degree angle). In other example embodiments, the interior walls are substantially vertical such that the diameter of the top cavity decreases slightly (e.g., at an approximate 75 to 90-degree angle) from the second point 130 to the third point 135.

The fins 110 protrude outward from the exterior wall of the cup 105. In one example embodiment, the top of each fin 110 is angled downward at an approximate 35-65-degree angle and is attached to the exterior wall from a third point 135 along the exterior of the cup 105 to a fourth point 140. The bottom of each fin 110 is substantially flush with the bottom 120 of the cup 105. The thickness of each fin 110 may be approximately 0.5-1.5 millimeters and the width of each fin (i.e., the distance from an inner edge where the fin is connected to the exterior wall of the cup 105 to an outer edge furthest from the body) may be approximately 15-20 millimeters.

The fins 110 are attached around the circumference of the cup 105. In the example embodiment shown in FIG. 1, eight fins 110 are attached to the cup 105. In other example embodiments, the vessel 100 has more or fewer fins, such as six or four. In some embodiments, the vessel 100 has an even number of fins. The fins may be evenly distributed around the vessel 100 or, alternatively, the separation between fins may vary.

Figure 2:
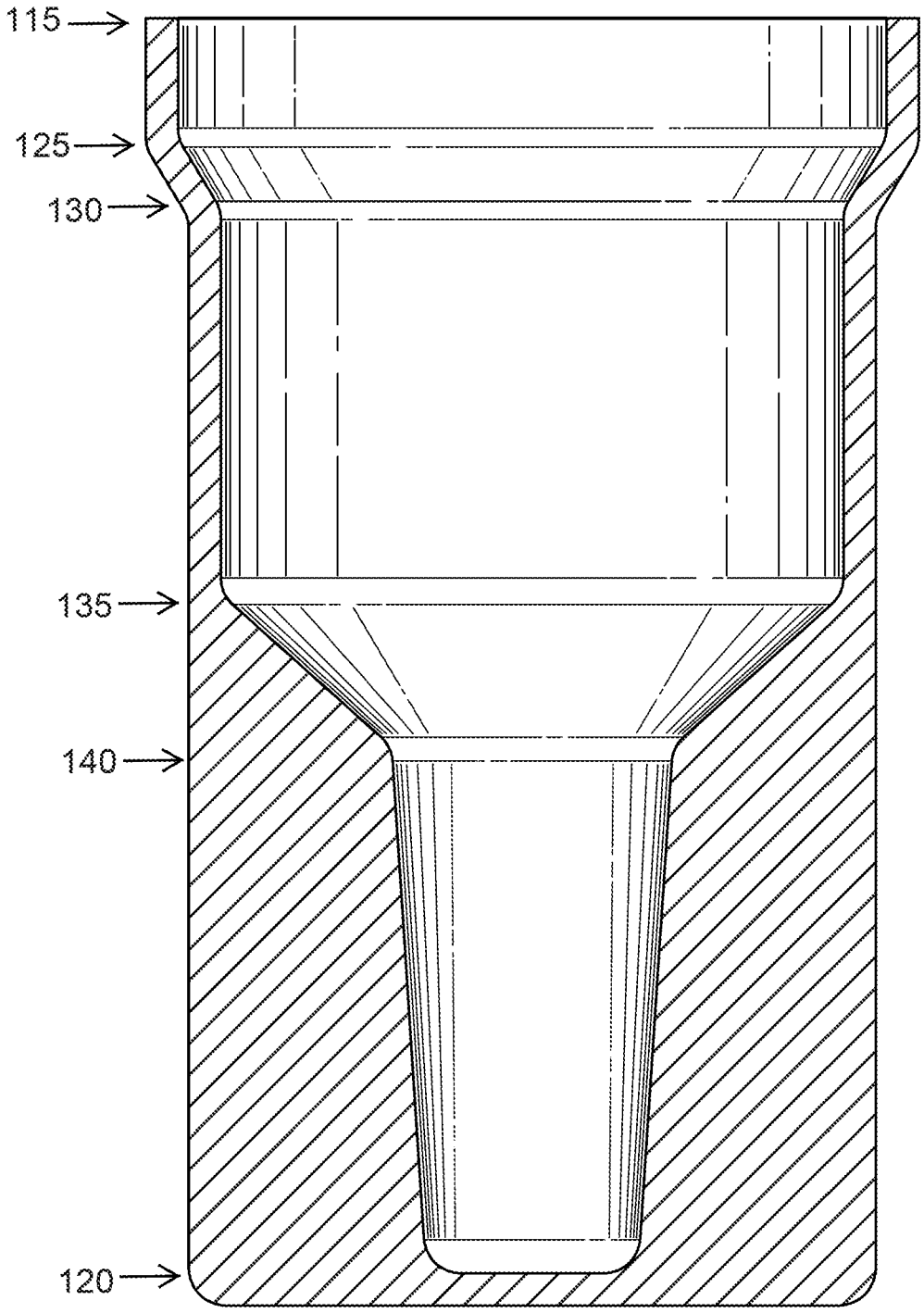
FIG. 2 illustrates a top view of a micro-titration vessel, according to an example embodiment.

FIG. 2 illustrates a cross-sectional view of a micro-titration vessel 100, according to an example embodiment. In the example embodiment shown in FIG. 4, the cup 105 is funnel-shaped such that the top 115 of the cup 105 is wider than the bottom 120 of the cup 105. The cup 105 angles inward toward the center of the cup 105 at a first point 125, the third point 135, and the fourth point 140 such that the cup 105 becomes narrower at three distinct points along the height of the cup 105.

In one example embodiment, the interior diameter of the cup 105 is approximately 40-75 millimeters at the top 115 and approximately 10-20 millimeters at the bottom 120. In various example embodiments, the width at the bottom 120 is in the range of 10% to 50% of the width at the top 11. As shown in FIG. 2, at the first point 125, the diameter of the cup 105 angles inward. The first point is approximately 5-10 millimeters from the top 115 and the interior wall angles inward at approximately 65-85-degree for approximately 4-6 millimeters such that the diameter of the cup 105 at a second point 130 is approximately 35-65 millimeters. In one example embodiment, the cup 105 includes a top cavity extending downward from the second point 130 to a third point 135 approximately 40-50 millimeters from the bottom 120. Further, at the third point 135, the interior walls of the cup 105 angle inward at an approximate 35-65-degree angle for approximately 10-12 millimeters, such that the diameter of the cup 105 at the fourth point 140 is approximately 15-25 millimeters. The cup 105 further includes a bottom cavity extending downward from the fourth point 140 approximately 30-40 millimeters from the bottom 120 to the bottom 120. At the fourth point 140, the interior walls of the cup 105 are substantially vertical (e.g., angling inward at an approximate 75-90-degree angle to the bottom 120), such that the diameter of the cup 105 at the bottom 120 is approximately 10-20 millimeters. In other example embodiments, the diameter of the cup 105 is the same at the fourth point 140 and the bottom 120 (i.e., the interior walls defining the bottom cavity are vertical). The titration cup structure can reduce the volume of API required. For example, in one embodiment, only 5.8 milliliters of liquid is required.

Figure 3:
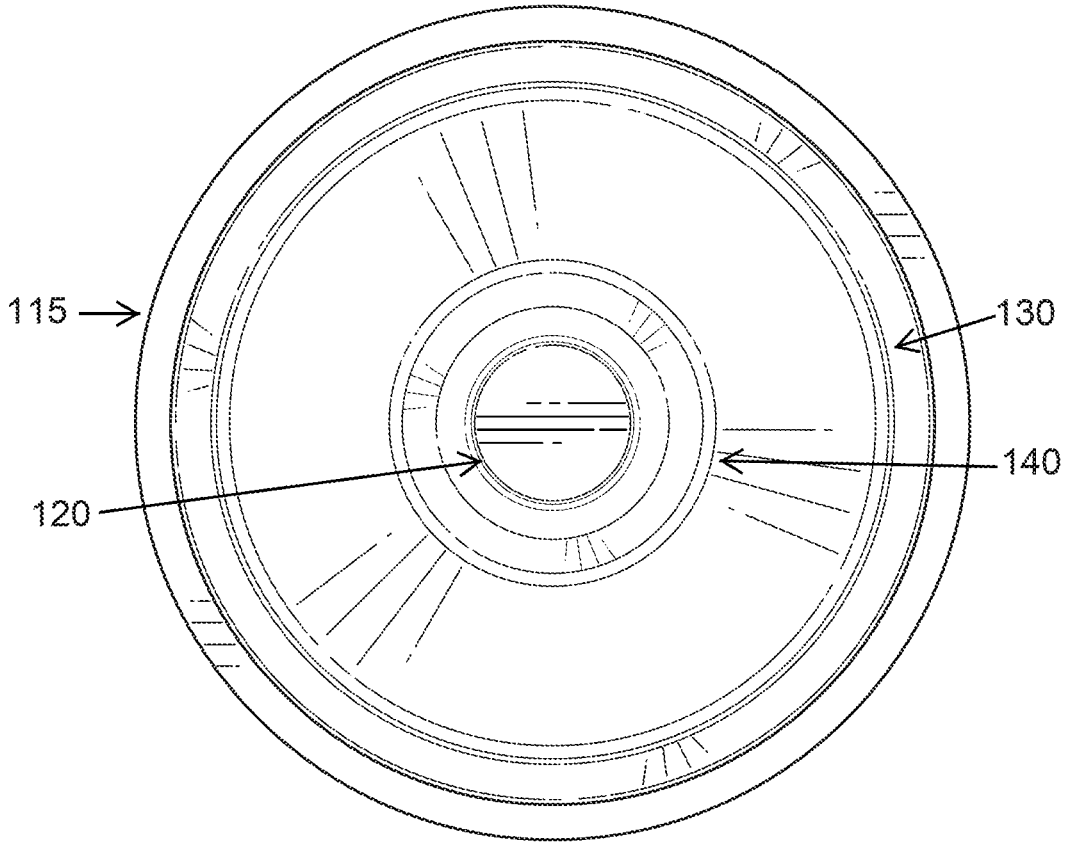
FIG. 3 illustrates a bottom view of a micro-titration vessel, according to an example embodiment.

FIG. 3 illustrates a top view of a micro-titration vessel 100, according to an example embodiment. In the example embodiment shown in FIG. 2, the widest point of the vessel 100 is at the top 115 such that the fins 110 are not visible from a top view of the vessel 110. The diameters of the various portions of the cup 105 are visible from the top view shown in FIG. 2. For example, as discussed above with respect to FIG. 1, the diameter of the cup 105 is approximately 40-75 millimeters at the top 115, approximately 35-65 millimeters at the second point 130, approximately 15-25 millimeters at the fourth point 140, and approximately 10-20 millimeters at the bottom 120.

Figure 4:
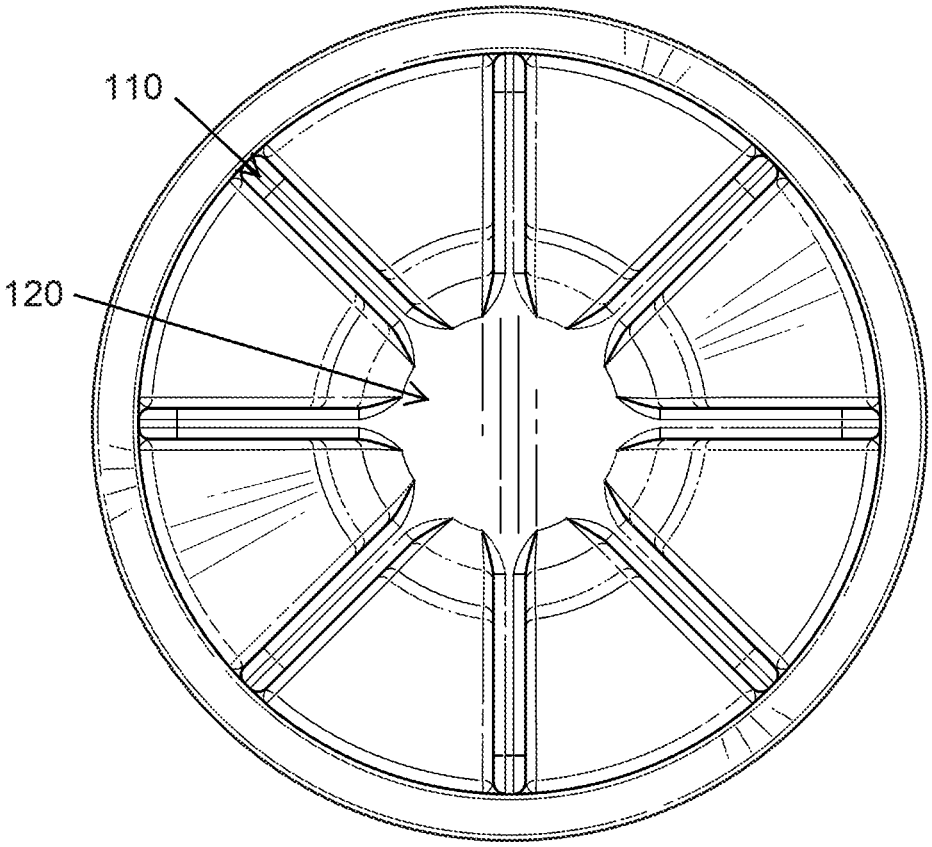
FIG. 4 illustrates a cross-sectional view of a micro-titration vessel, according to an example embodiment.

FIG. 4 illustrates a bottom view of a micro-titration vessel 100, according to an example embodiment. In the example embodiment shown in FIG. 3, eight fins 110 protrude outward from the exterior wall of the cup 105. In other embodiments, the vessel 100 has more or fewer fins. In one example embodiment, the bottoms of the fins 110 are flush with the bottom 120 of the cup 105. Alternatively, the bottoms of the finds 110 protrude downward past the bottom 120 to form feet on the bottom of the vessel 100.

The width of each fin 110 may be approximately 15-20 millimeters such that the diameter of the bottom of the vessel 100 may be approximately 40-60 millimeters. In one example embodiment, the bottom of the vessel 100 is narrower than the top of the vessel 100. For example, the diameter of the vessel 100 at the top 115 of the cup 105 might be 54 millimeters, while the diameter of the vessel 100 at the bottom of the fins 110 might be 49 millimeters. Alternatively, the diameter of the bottom 120 of the vessel 100, from fin tip to fin tip, and the diameter of the top 115 of the vessel may be substantially the same.

Additional Configuration Considerations

The disclosed configurations provide a number of advantages over existing titration vessels. For example, the inward angling of the walls of the vessel results in a smaller surface area at the bottom of the vessel such that the vessel fits onto automated titration instruments while requiring less titrant to perform the titration at the bottom of the vessel. The funnel shape of the cup allows the head of a titration machine to fit inside the wider portion at the top of the cup to inject the titrant into the lower part of the cup through a pipette. Because titration must occur at at least a certain depth, the narrower portion at the bottom of the cup allows a smaller amount of API to be used. Furthermore, in some embodiments, the design of the cup allows it to be used with existing automatic titration machines without requiring those machines to be modified.

As used herein, the terms "comprises," "comprising," "includes," "including," "has," "having," or any other variations thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs as disclosed from the principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

The invention claimed is:

1. A titration vessel comprising:

a top portion, the top portion having an opening and an interior wall defining a top cavity having a first diameter, wherein the interior wall defining the top cavity is substantially parallel to a vertical axis of the titration vessel;

a bottom portion, the bottom portion having a wall including a side and a bottom, an interior surface of the side defining a bottom cavity having a second diameter and an interior surface of the bottom enclosing a bottom end of the bottom cavity that is furthest from the top portion, the second diameter less than the first diameter, wherein the interior wall defining the bottom cavity is substantially parallel to the vertical axis of the titration vessel and the second diameter is approximately 10 to 20 millimeters;

a funneling portion disposed between the top portion and the bottom portion, the funneling portion having an interior funnel wall defining a funnel cavity, the funnel cavity having the first diameter where the funnel cavity adjoins the top cavity and the second diameter where the funnel cavity adjoins the bottom cavity, wherein the funneling portion angles inward at approximately 35 to 65 degrees relative to the vertical axis of the titration vessel; and a plurality of equidistantly spaced fins protruding outward from an exterior of the side of the wall of the bottom portion of the vessel, the fins attached to the exterior of the side of the wall from an approximate midpoint of the vessel to the bottom of the wall of the bottom portion, wherein bottoms of the fins are level with an exterior surface of the bottom of the wall, wherein the titration vessel is a unibody construction.

2. The titration vessel of claim 1, wherein the plurality of fins comprises at least four fins.

3. The titration vessel of claim 1, wherein the vessel is comprised of a thermoplastic polymer.

4. The titration vessel of claim 1, wherein a height of the vessel is approximately 80 to 100 millimeters.

5. The titration vessel of claim 1, wherein the first diameter is approximately 35 to 65 millimeters.

6. The titration vessel of claim 1, wherein a thickness of each fin is approximately 0.5 to 1.5 millimeters.

7. The titration vessel of claim 1, wherein a width of each fin is approximately 15 to 20 millimeters, the width of the fin comprising a distance from an inner edge where the fin is connected to the exterior of the side of the wall to an outer edge furthest from the exterior of the side of the wall.

8. The titration vessel of claim 1, further comprising a second funneling portion, the second funneling portion above the top cavity and having an interior wall defining a second funnel cavity, the second funnel cavity having the first diameter where the second funnel cavity adjoins the top cavity and a third diameter at a top of the second funnel cavity, the third diameter greater than the first diameter.

9. The titration vessel of claim 8, wherein the interior wall of the second funneling portion angles inward at approximately 65 to 85 degrees relative to the vertical axis of the titration vessel.

10. The titration vessel of claim 1, wherein the interior wall defining the top cavity is at 75 to 90 degrees relative to the vertical axis of the titration vessel.

11. The titration vessel of claim 1, wherein the interior wall defining the bottom cavity is at 75 to 90 degrees relative to the vertical axis of the titration vessel.

* * * * *